US008932787B2

(12) United States Patent
Kurimoto et al.

(10) Patent No.: US 8,932,787 B2
(45) Date of Patent: Jan. 13, 2015

(54) ELECTROPHOTOGRAPHIC PHOTOCONDUCTOR, ELECTROPHOTOGRAPHIC APPARATUS AND PROCESS CARTRIDGE

(71) Applicants: Eiji Kurimoto, Shizuoka (JP); Tadayoshi Uchida, Yamanashi (JP); Hideki Nakamura, Yamanashi (JP)

(72) Inventors: Eiji Kurimoto, Shizuoka (JP); Tadayoshi Uchida, Yamanashi (JP); Hideki Nakamura, Yamanashi (JP)

(73) Assignee: Ricoh Company, Ltd., Tokyo (JP)

( * ) Notice: Subject to any disclaimer, the term of this patent is extended or adjusted under 35 U.S.C. 154(b) by 13 days.

(21) Appl. No.: 13/715,322

(22) Filed: Dec. 14, 2012

(65) Prior Publication Data

US 2013/0157181 A1 Jun. 20, 2013

(30) Foreign Application Priority Data

Dec. 20, 2011 (JP) ..... 2011-277844

(51) Int. Cl.

| | |
|---|---|
| ***G03G 5/14*** | (2006.01) |
| ***G03G 5/047*** | (2006.01) |
| ***G03G 21/18*** | (2006.01) |
| ***G03G 5/06*** | (2006.01) |

(52) U.S. Cl.

CPC ..... *G03G 5/047* (2013.01); *G03G 21/18* (2013.01); *G03G 5/0614* (2013.01); *G03G 5/0668* (2013.01); *G03G 5/0672* (2013.01); *G03G 5/144* (2013.01)

USPC ..... 430/63; 430/60; 430/62; 399/159

(58) Field of Classification Search

USPC ..... 430/60, 62, 63; 399/159

See application file for complete search history.

(56) References Cited

U.S. PATENT DOCUMENTS

| | | | | |
|---|---|---|---|---|
| 5,932,385 | A * | 8/1999 | Takamura et al. | 430/63 |
| 5,958,638 | A | 9/1999 | Katayama et al. | |
| 2003/0190540 | A1* | 10/2003 | Shoshi et al. | 430/78 |
| 2009/0010664 | A1 | 1/2009 | Nukada et al. | |
| 2009/0253061 | A1* | 10/2009 | Yagi et al. | 430/58.65 |
| 2009/0311616 | A1 | 12/2009 | Shimoyama et al. | |
| 2009/0325093 | A1* | 12/2009 | Wu | 430/58.8 |
| 2010/0233602 | A1* | 9/2010 | Yamamoto et al. | 430/58.85 |
| 2011/0020739 | A1* | 1/2011 | Nakamura et al. | 430/56 |

FOREIGN PATENT DOCUMENTS

| | | | |
|---|---|---|---|
| CN | 101339377 | A | 1/2009 |
| CN | 101604125 | A | 12/2009 |

(Continued)

OTHER PUBLICATIONS

Chinese Office Action issued in corresponding Chinese patent application No. 201210559107.0 dated Jun. 5, 2014 (with English translation).

*Primary Examiner* — Peter Vajda

(74) *Attorney, Agent, or Firm* — Oblon, Spivak, McClelland, Maier & Neustadt, L.L.P.

(57) ABSTRACT

An electrophotographic photoconductor including: an electroconductive substrate; an intermediate layer; and a photoconductive layer, the intermediate layer and the photoconductive layer being on the electroconductive substrate, wherein the intermediate layer includes an inorganic pigment and a binder resin, wherein a volume ratio of the inorganic pigment in the intermediate layer is 30% by volume to 50% by volume, wherein the inorganic pigment comprises titanium oxide and a content of the titanium oxide in the inorganic pigment is 70% by mass to 90% by mass, wherein the inorganic pigment has a specific surface area of 70 $m^2/g$ to 140 $m^2/g$, and wherein the intermediate layer has a volume resistivity at an electrical field intensity of $2.5\times10^5$ V/cm of $5\times10^{11}$ Ω·cm to $1\times10^{13}$ Ω·cm.

10 Claims, 1 Drawing Sheet

(56) References Cited

FOREIGN PATENT DOCUMENTS

| | | |
|---|---|---|
| JP | 05-165241 | 7/1993 |
| JP | 10-228125 | 8/1998 |
| JP | 11-015184 | 1/1999 |
| JP | 11-202518 | 7/1999 |
| JP | 2002-196522 | 7/2002 |
| JP | 2003-057862 | 2/2003 |
| JP | 2003-066636 | 3/2003 |

* cited by examiner

ELECTROPHOTOGRAPHIC PHOTOCONDUCTOR, ELECTROPHOTOGRAPHIC APPARATUS AND PROCESS CARTRIDGE

BACKGROUND OF THE INVENTION

1. Field of the Invention

The present invention relates to an electrophotographic photoconductor, an electrophotographic apparatus and a process cartridge.

2. Description of the Related Art

Electrophotographic apparatuses are used in, for example, copiers and laser beam printers, since they have high process speed and printing quality.

For photoconductors used in electrophotographic apparatuses, development has actively been made on organic photoconductors (OPCs) using organic photoconductive materials, and OPCs have been used gradually widely.

Also, the structure of photoconductors has been changed from a single-layered structure where a charge-transfer complex or a charge generating material is dispersed in a binder resin, to a functionally-separated structure where a charge generation layer and a charge transport layer are responsible for respective functions, and their performance has been improving.

In addition, an intermediate layer has been provided as a layer constituting a photoconductor in order to, for example, improve adhesiveness to a photoconductive layer, coating property of a photoconductive layer and chargeability, to prevent unwanted charges from being injected from a substrate, and to cover defects on a substrate.

For example, functionally-separated photoconductors that are mainly used at present have a structure where a charge generation layer and a charge transport layer are provided on an intermediate layer which has previously been provided on an electroconductive substrate.

Conventionally known resins used for intermediate layers include water-soluble resins such as polyvinyl alcohols and casein; alcohol-soluble resins such as Nylon resins; polyurethanes, melamin resins, phenol resins, alkyd resins, epoxy resins and siloxane resins.

Moreover, curing such resins with heating to form three-dimensional network structures has been attempted to increase their resistance to solvents.

Among them, such resins as melamin resins, alkyd/melamine resins, acryl/melamine resins, phenol resins and polyamide copolymers are used since these are superior in providing stable coating liquids.

There has also been proposed a photoconductor having an intermediate layer the resin of which contains a metal oxide serving as an inorganic pigment dispersed therein.

When specular reflection occurs on a surface of an intermediate layer in writing by coherent light, specularly reflected light interfaces together to make an image involve unevenness in density in moiré pattern.

However, incorporation of a metal oxide into an intermediate layer as a white pigment can prevent specular reflection on the surface of the intermediate layer to suppress generation of moiré.

Also, when a surface of a photoconductor is charged in a charging step, opposite charges are induced on the substrate side. In this case, when the electrical resistance of an intermediate layer is too low, the intermediate layer cannot block injection of charges from the substrate into the photoconductive layer. As a result, portions where charges are injected from the substrate into the photoconductive layer are not sufficiently charged to cause image defects such as black spots.

Meanwhile, when the electrical resistance of an intermediate layer is too high, the intermediate layer blocks positive and negative charges generated in a charge generation layer that are to be transferred to the substrate side upon exposure to light, leading to increase in residual potential on the surface of the intermediate layer. In one measure to suppress injection of charges from the substrate to the photoconductive layer and increase in residual potential, a metal oxide which is an electroconductor is added to a relatively electrically insulating resin, and the ratio between the metal oxide and the resin and the thickness of an intermediate layer are controlled to adjust the electrical resistance of the intermediate layer. This measure can overcome such disadvantages to some extent but when it is taken alone, improvements made on the resultant intermediate layer are limited.

Also, when a photoconductor is repeatedly used, charges trapped in its intermediate layer in a charging step causes delayed charging, in which the surface potential of the photoconductor does not increase right after charges are given to the photoconductor but normal charging starts after a certain amount of charges flows into the photoconductor.

Even when a photoconductor involving delayed charging is subjected to a charging process under such conditions as to provide a normal photoconductor with a sufficient charge potential, the surface potential of the photoconductor cannot reach a desired level before imagewise light exposure, so that unevenness in density of images disadvantageously occurs.

When a metal oxide is incorporated into the intermediate layer, the metal oxide is appropriately selected or subjected to surface treatments or various additives are added to the intermediate layer, in order to attain stable electrical characteristics and prevent formation of abnormal images such as black spots. For example, there are proposed methods for suppressing increase in residual potential of a photoconductor or formation of images with black spots or both of them, by incorporating, into an intermediate layer, a metal oxide whose surface has been treated with an organic silicon compound (see, for example, Japanese Patent Application Laid-Open (JP-A) Nos. 2003-57862, 2003-66636 and 2002-196522).

Another proposed method forms an intermediate layer containing a coupling agent having an unsaturated bond, a metal oxide and a binding agent, suppressing increase in residual potential of a photoconductor and improve storage stability of a coating liquid (see, for example, JP-A No. 11-15184).

Still another proposed method forms an intermediate layer containing polyol-coated titanium oxide particles and a binder resin, improving electrical characteristics and imaging characteristics of an electrophotographic photoconductor in a wide range of environments from high-temperature, high-humidity environments to low-temperature, low-humidity environments (see, for example, JP-A No. 10-228125).

Yet another proposed method incorporates zirconium oxide into an intermediate layer in an amount of 20% by mass or more, improving environmental stability and reducing image defects (see, for example, JP-A No. 11-202518).

Even another proposed method incorporates a white metal oxide or metal fluoride into an intermediate layer and incorporates a polyalkylene glycol into a charge generation layer or the intermediate layer, reducing residual potential and avoiding delayed charging due to fatigue (see, for example, JP-A No. 05-165241).

These methods can prevent increase in residual potential and formation of images with black spots but cause delayed charging due to repetitive use of the photoconductors. As such, there have been no methods that do not cause delayed charging and do reduce increase in residual potential and formation of images with black spots.

Therefore, at present, demand has arisen for an electrophotographic photoconductor that changes in characteristics to a lesser extent even after repetitive use and involves increase in residual potential and formation of images with black spots to a lesser extent.

SUMMARY OF THE INVENTION

The present invention aims to solve the existing problems and provide an electrophotographic photoconductor that changes in characteristics to a lesser extent even after repetitive use and involves increase in residual potential and formation of images with black spots to a lesser extent.

Means for solving the above problems are as follows.

An electrophotographic photoconductor of the present invention includes:

an electroconductive substrate;

an intermediate layer; and a photoconductive layer, the intermediate layer and the photoconductive layer being on the electroconductive substrate, wherein the intermediate layer includes an inorganic pigment and a binder resin, wherein a volume ratio of the inorganic pigment in the intermediate layer is 30% by volume to 50% by volume, wherein the inorganic pigment includes titanium oxide and a content of the titanium oxide in the inorganic pigment is 70% by mass to 90% by mass, wherein the inorganic pigment has a specific surface area of 70 $m^2/g$ to 140 $m^2/g$, and wherein the intermediate layer has a volume resistivity at an electrical field intensity of $2.5\times10^5$ V/cm of $5\times10^{11}$ Ω·cm to $1\times10^{13}$ Ω·cm.

When the content of the titanium oxide in the inorganic pigment is less than 70% by mass, the impurities contained cause increase in residual potential during repetitive use. Whereas when it is more than 90% by mass, the volume resistivity of the intermediate layer considerably decreases, leading to degradation of image qualities during repetitive use to cause defects such as black spots or fogging. When the specific surface area is less than 70 $m^2/g$, dispersion treatment becomes easy but concealment of the pigment and the resin becomes poor, so that the volume resistivity of the intermediate layer decreases and abnormal images tend to be formed. Whereas when it is more than 140 $m^2/g$, the surface area of the inorganic pigment becomes large, so that the liquid viscosity tends to increase, making it difficult to attain a good dispersion state and stable production of an intermediate layer. When the volume ratio of the inorganic pigment in the intermediate layer is less than 30%, the volume resistivity of the intermediate layer increases to cause increase in residual potential. Whereas it is more than 50%, the intermediate layer becomes poor in coating qualities, resulting in reduction of adhesiveness to other layers. When the volume resistivity of the intermediate layer at an electrical field intensity of $2.5\times10^5$ V/cm is less than $5\times10^{11}$ Ω·cm, abnormal current generated from the substrate causes defects such as black spots or fogging. Whereas when it is more than $1\times10^{13}$ Ω·cm, the sensitivity decreases and the residual potential increases.

The present invention can provide an electrophotographic photoconductor that changes in characteristics to a lesser extent even after repetitive use and involves increase in residual potential and formation of images with black spots to a lesser extent. This electrophotographic photoconductor can solve the above existing problems.

Figure 1:
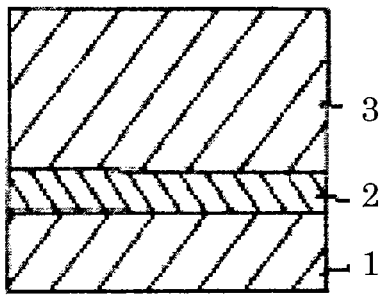
FIG. 1 is a schematic cross-sectional view of one exemplary structure of an electrophotographic photoconductor of the present invention.

DETAILED DESCRIPTION OF THE INVENTION (Electrophotographic Photoconductor)

An electrophotographic photoconductor of the present invention includes an electroconductive substrate, an intermediate layer and a photoconductive layer, the intermediate layer and the photoconductive layer being on the electroconductive substrate; and, if necessary, further includes other layers.

<Intermediate Layer>

The intermediate layer contains at least an inorganic pigment and a binder resin; and, if necessary, further contains other ingredients.

—Inorganic Pigment—

The inorganic pigment is not particularly limited and may be appropriately selected depending on the intended purpose so long as it has the below-described content of the titanium oxide and specific surface area.

—Content of the titanium oxide in the inorganic pigment—

The content of the titanium oxide of the inorganic pigment is adjusted to 70% by mass to 90% by mass. When the content of the titanium oxide of the inorganic pigment is less than 70% by mass, the impurities contained cause increase in residual potential during repetitive use. Whereas when it is more than 90% by mass, the volume resistivity of the intermediate layer considerably decreases, leading to degradation of image qualities during repetitive use to cause defects such as black spots or fogging.

The content of the titanium oxide of the inorganic pigment can be measured by the method described in JIS K5116.

Preferably, titanium oxide particles used in the present invention have been treated with aluminum hydroxide.

The titanium oxide particles treated with aluminum hydroxide can be produced as follows, for example. Specifically, rutile-type titanium oxide particles having an average primary particle diameter of about 10 nm to about 20 nm are dispersed in an aqueous solution of an aluminum salt such as aluminum chloride. Then, an alkali such as caustic soda is added to the dispersion to precipitate aluminum hydroxide on the surfaces of the titanium oxide particles. Next, the resultant titanium oxide particles are ignited at about 500° C. to obtain the titanium oxide treated with aluminum hydroxide.

Although the titanium oxide treated with aluminum hydroxide can be produced in the above-described method, a commercially available inorganic pigment may be used instead and TTO-51(A) (product of ISHIHARA SANGYO KAISHA, LTD.) is preferred. There are also TTO-55(A) and other products having specific surface areas and contents of titanium oxide different from those of TTO-51(A), but these are not preferred since their specific surface areas and contents of titanium oxide do not fall within the corresponding ranges defined in the present invention.

—Specific Surface Area of the Inorganic Pigment—

The specific surface area of the inorganic pigment refers to a value measured by a simple BET method based on adsorption of nitrogen gas. In the present invention, the specific surface area thereof is 70 $m^2/g$ to 140 $m^2/g$. When it is less than 70 $m^2/g$, dispersion treatment becomes easy but concealment of the pigment and the resin becomes poor, so that the volume resistivity of the intermediate layer decreases and abnormal images tend to be formed. Whereas when it is more than 140 $m^2/g$, the surface area of the inorganic pigment becomes large, so that the liquid viscosity tends to increase, making it difficult to attain a good dispersion state and stable production of an intermediate layer.

—Volume Ratio of the Inorganic Pigment—

The volume ratio of the inorganic pigment refers to a ratio by volume of the inorganic pigment in the total volume of the inorganic pigment and the binder resin which is converted from their specific gravities. The ratio by volume of the inorganic pigment in the total volume of the inorganic pigment and the binder resin is calculated by converting their masses to volumes based on the specific gravities. In the present invention, the volume ratio of the inorganic pigment in the intermediate layer is 30% by volume to 50% by volume. When the volume ratio of the inorganic pigment therein is less than 30% by volume, the characteristics of the intermediate layer depend on those of the binder resin, so that the residual potential greatly changes and unevenness in images tends to occur especially due to changes in temperature and humidity and repetitive use. Whereas it is more than 50% by volume, the intermediate layer has more voids therein, resulting in reduction of adhesiveness to the charge generation layer, for example. Moreover, when it is more than 75% by volume, air is contained in the intermediate layer to be air bubbles upon coating and drying of the photoconductive layer, causing coating defects.

Calculation Method of the Volume Ratio of the Inorganic Pigment

Volume of the inorganic pigment converted from the mass of the inorganic pigment: Vf Volume of the binder resin converted from the mass of the binder resin: Vr $$\text{Volume ratio of the inorganic pigment} = Vf/(Vf+Vr) \times 100$$

—Binder Resin—

The binder resin is not particularly limited and may be appropriately selected depending on the intended purpose. Examples thereof include polymers and copolymers of vinyl compounds such as styrene, vinyl acetate, acrylic acid esters and methacrylic acid esters; silicone resins, phenoxy resins, polysulfon resins, polyvinyl butyral resins, polyvinyl formal resins, polyester resins, cellulose ester resins, cellulose ether resins, urethane resins, phenol resins, epoxy resins, polycarbonate resins, polyarylate resins, polyamide resins, polyimide resins, melamine resins and alkyd resins. Among these resins, polyamide resins are preferred from the viewpoints of less increase in residual potential accompanied by repetitive use and stability and coatability of a liquid for an intermediate layer. From the viewpoint of stability to the environment, more preferred are polyamide copolymers where three or four of 6 Nylon, 66 Nylon, 610 Nylon and 12 Nylon are copolymerized.

—Other Ingredients—

The other ingredients are not particularly limited and may be appropriately selected depending on the intended purpose so long as the effects of the present invention are not impaired.

—Volume Resistivity of the Intermediate Layer—

The volume resistivity of the intermediate layer is measured by the following method. Specifically, an intermediate layer is formed on an aluminum substrate using a sheet coater and dried at 100° C. for 10 min so that the thickness of the intermediate layer is adjusted to 1 μm. Subsequently, gold is vapor-deposited on the intermediate layer to form an electrode, and the volume resistivity between the aluminum substrate and the gold electrode is measured using HIGH RESISTANCE METER 4339A (product of HEWLETT PACKARD Co.).

In the present invention, the volume resistivity of the intermediate layer at an electrical field intensity of $2.5\times10^5$ V/cm is $5\times10^{11}$ Ω·cm to $1\times10^{13}$ Ω·cm. When it is less than $5\times10^{11}$ Ω·cm, required charging characteristics cannot be obtained, so that unevenness in image density tends to occur. In addition, abnormal current generated from the substrate causes defects such as black spots or fogging. Whereas when it is more than $1\times10^{13}$ Ω·cm, the sensitivity decreases and the residual potential increases.

—Thickness of the Intermediate Layer—

The thickness of the intermediate layer is preferably adjusted to fall within the range of 0.1 μm to 50 μm, more preferably 1 μm to 8 μm. When the thickness of the intermediate layer is smaller than 0.1 μm, the intermediate layer does not have its sufficient function, and the effects to fatigue of pre-exposure become small. Whereas when the thickness of the intermediate layer is larger than 50 μm, smoothness of the coated surface is lost. When it is larger than 8 μm, the photoconductor decreases in sensitivity and, although the effects to fatigue of pre-exposure are maintained, the effects to environmental changes become lost.

<Electroconductive Substrate>

The electroconductive substrate is not particularly limited and may be appropriately selected depending on the intended purpose so long as it exhibits a volume resistivity of $10^{10}$ Ω·cm or less. Examples thereof include: coated products obtained by coating a plastic film, a cylindrical plastic or paper, which serves as a substrate, with a metal such as aluminum, nickel, chromium, nichrome, copper, gold, silver or platinum or with a metal oxide such as tin oxide or indium oxide through vapor deposition or sputtering; plates made of, for example, aluminum, aluminum alloys, nickel and stainless steel; and tubes produced by forming the above plate into a raw tube through machining such as extrusion and pultrusion and subjecting the raw tube to surface treatments such as cutting, superfinishing and polishing. In addition, the endless nickel belt or the endless stainless-steel belt disclosed in Japanese Patent Application Publication (JP-B) No. 52-36016 may also be used as the electroconductive substrate.

The above substrate may be provided with an electroconductive layer formed through coating of a liquid containing electroconductive powder dispersed in an appropriate binder resin, and used as the above electroconductive substrate.

The electroconductive powder is not particularly limited and may be appropriately selected depending on the intended purpose. Examples thereof include: carbon black and acethylene black; powder of metals such as aluminum, nickel, iron, NICHROME, copper, zinc and silver; and powder of metal oxides such as electroconductive tin oxide and ITO.

Examples of the binder resin, which is used together with the electroconductive powder, include thermoplastic resins, thermosetting resins and photocurable resins such as polystyrenes, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetates, polyvinylidene chlorides, polyarylate resins, phenoxy resins, polycarbonates, cellulose acetate resins, ethyl cellulose resins, polyvinyl butyrals, polyvinyl formals, polyvinyl toluenes, poly-N-vinylcarbazoles, acrylic resins, silicone resins, epoxy resins, melamine resins, urethane resins, phenol resins and alkyd resins.

The electroconductive layer of the electroconductive substrate may be formed through coating of a liquid containing the electroconductive powder and the binder resin in an appropriate solvent such as tetrahydrofuran, dichloromethane, methyl ethyl ketone or toluene.

In addition, a substrate obtained by providing an appropriate cylindrical support with, as an electroconductive layer, a heat-shrinkable tubing containing the above electroconductive powder and a material such as polyvinyl chloride, polypropylene, polyester, polystyrene, polyvinylidene chloride, polyethylene, chlorinated rubber or polytetrafluoroethylene resin is suitably used as the electroconductive substrate in the present invention.

<Photoconductive Layer>

The photoconductive layer may have a single-layered structure or a functionally-separated structure where a charge generation layer and a charge transport layer are laminated on top of each other. The following description takes the functionally-separated structure as an example.

—Charge Generation Layer—

The charge generation layer contains a charge generating material as a main ingredient; and, if necessary, further contains a binder resin or other ingredients or both thereof.

—Charge Generating Material—

The charge generating material may be an inorganic material or an organic material.

The charge generating material may be a single material or a mixture of two or more kinds of materials.

The inorganic material is not particularly limited and may be appropriately selected depending on the intended purpose. Examples thereof include crystalline selenium, amorphous selenium, selenium-tellurium, selenium-tellurium-halogen, a selenium-arsenic compound and amorphous silicone.

As the amorphous silicone, suitably used are amorphous silicone in which dangling bonds are terminated with hydrogen atoms or halogen atoms and amorphous silicone doped with a boron atom or a phosphorus atom.

The organic material is not particularly limited and may be appropriately selected depending on the intended purpose. Examples thereof include phthalocyanine pigments (e.g., metal phthalocyanines and metal-free phthalocyanines), azulenium salt pigments, methine squarate pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distilyloxadiazole skeleton, azo pigments having a distilylcarbazole skeleton, perylene pigments, anthraquinone and multicyclic quinone pigments, quinoneimine pigments, diphenylmethane and triphenylmethane pigments, benzoquinone and naphthoquinone pigments, cyanine and azomethine pigments, indigoido pigments and bis-benzimidazole pigments.

—Binder Resin—

The binder resin is not particularly limited and may be appropriately selected depending on the intended purpose. Examples thereof include polyamides, polyurethanes, epoxy resins, polyketones, polycarbonates, polyarylates, silicone resins, acrylic resins, polyvinylbutylals, polyvinylformals, polyvinyl ketones, polystyrenes, poly-N-vinylcarbazols and polyacrylamides.

The above binder resins may be used alone or as a mixture of two or more of them.

—Other Ingredients—

Examples of the other ingredients include additives such as a charge transporting material, a solvent, a sensitizing agent, a dispersing agent, a surfactant and silicone oil.

The charge transporting material, which can additionally be incorporated into the charge generation layer, is classified into an electron transporting compound and a hole transporting compound.

The electron transporting compound is not particularly limited and may be appropriately selected depending on the intended purpose. Examples thereof include electron-accepting compounds such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one and 1,3,7-trinitrodibenzothiophene-5,5-dioxide.

The above electron transporting compounds may be used alone or as a mixture of two or more of them.

The hole transporting compound is not particularly limited and may be appropriately selected depending on the intended purpose. Examples thereof include an electron-donating compound.

The electron-donating compound is not particularly limited and may be appropriately selected depending on the intended purpose. Examples thereof include oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzoimidazole derivatives and thiophene derivatives.

The above hole transporting compounds may be used alone or as a mixture of two or more of them.

—Method for Forming the Charge Generation Layer—

A method for forming the charge generation layer is roughly classified into a vacuum thin-film formation method and a casting method using a solution dispersion system.

The vacuum thin-film formation method is not particularly limited and may be appropriately selected depending on the intended purpose. Examples thereof include a vacuum vapor evaporation method, a glow discharge decomposition method, an ion plating method, a sputtering method, a reactive sputtering method and a CVD method. With these methods, the charge generation layer can be formed successfully from the above inorganic material or the above organic material.

When the charge generation layer is formed with the casting method, for example, the above inorganic material or the above organic material and an optional binder resin that is used if necessary are dispersed in a solvent, such as tetrahydrofuran, cyclohexanone, dioxane, dichloroethane or butanone, using a ball mill, an attritor or a sand mill, and the obtained dispersion liquid is appropriately diluted and then coated.

The coating of the dispersion liquid can be performed by, for example, a dip coating method, a spray coating method or a bead coating method.

The thickness of the charge generation layer formed in this manner is preferably about 0.01 μm to about 5 μm, more preferably about 0.05 μm to about 2 μm.

—Charge Transport Layer—

The charge transport layer can be formed as follows: a mixture or copolymer containing a charge transporting material and a binder resin as main ingredients is dissolved or dispersed in an appropriate solvent, and the obtained solution or dispersion is coated and dried.

—Charge Transporting Material—

The charge transporting material is not particularly limited and may be appropriately selected depending on the intended purpose. Examples thereof include: hole transporting compounds having a hole transportable structure such as triarylamine, hydrazone, pyrazoline and carbazole; and electron transporting compounds having an electron transportable structure such as fused polycyclic quinones, diphenoquinone, and electron-attracting aromatic rings having a cyano group and/or a nitro group.

The hole transporting compound is not particularly limited and may be appropriately selected depending on the intended purpose. Examples thereof include poly-N-vinylcarbazoles and derivatives thereof, poly-γ-carbazolylethylglutamates and derivatives thereof, pyrene-formaldehyde condensates and derivatives thereof, polyvinyl pyrenes, polyvinyl phenanthrenes, polysilanes, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives and other known materials. The above hole transporting materials may be used alone or as a mixture of two or more of them.

The electron transporting compound is not particularly limited and may be appropriately selected depending on the intended purpose. Examples thereof include electron-accepting compounds such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide and diphenoquinone derivatives. The above electron transporting compounds may be used alone or as a mixture of two or more of them.

The above charge transporting materials may be used alone or as a mixture of two or more of them.

Among the above charge transporting materials, a charge transporting material represented by General Formula (1) is chemically stable. This charge transporting material shows stable light attenuation even when the thickness of the charge transport layer is smaller than a generally selected thickness.

Specifically, charge transporting materials expressed by Formulas (1-1) to (1-5) are excellent, with the charge transporting material expressed by Formula (1-1) being particularly excellent. However, the charge transporting materials are not limited to the charge transporting materials expressed by Formulas (1-1) to (1-5).

General Formula (1)

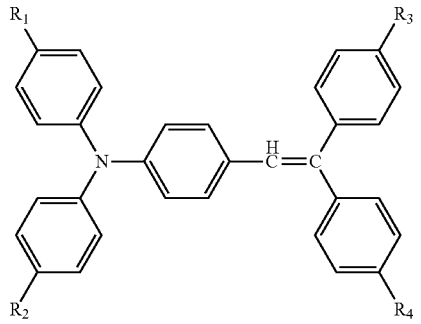

where $R_1$ to $R_4$ each independently represent hydrogen, a C1-C6 alkyl group which may have a substituent, or a C1-C6 alkoxy group which may have a substituent.

(1-1)

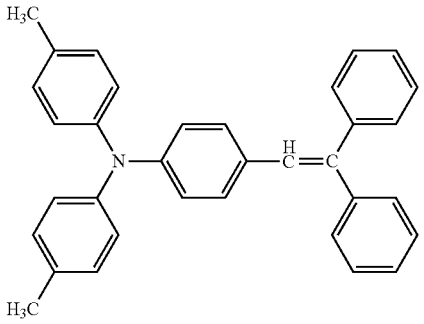

(1-2)

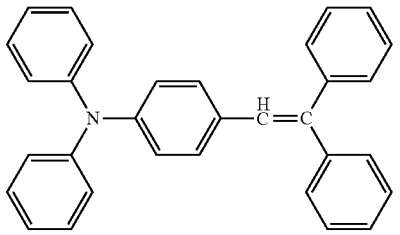

(1-3)

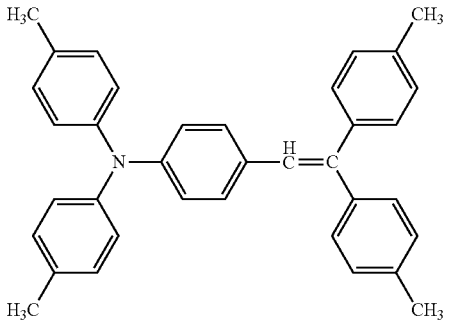

-continued (1-4)

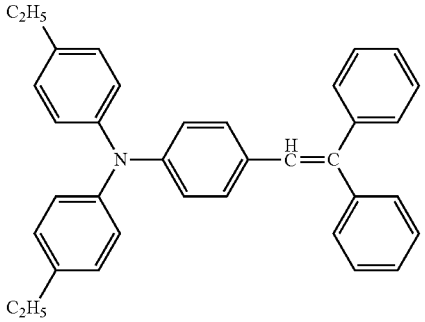

(1-5)

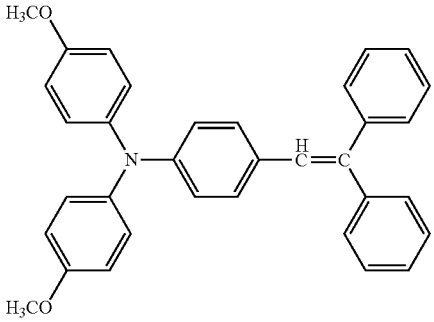

In addition, a charge transporting material represented by General Formula (2) is also chemically stable. This charge transporting material has a low potential after light exposure and is stable, and shows stable light attenuation even when the thickness of the charge transport layer is smaller than a generally selected thickness.

Specifically, charge transporting materials expressed by Formulas (2-1) to (2-5) are excellent, with the charge transporting material expressed by Formula (2-1) being particularly excellent. However, the charge transporting materials are not limited to the charge transporting materials expressed by Formulas (2-1) to (2-5).

General Formula (2)

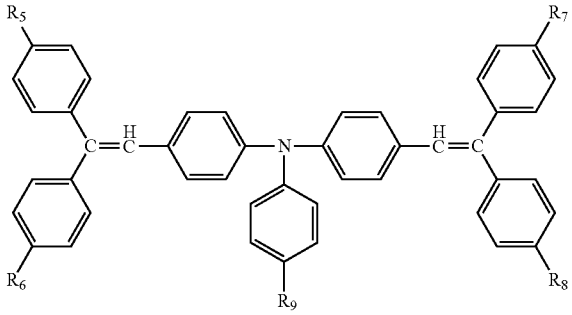

where $R_5$ to $R_9$ each independently represent hydrogen, a C1-C6 alkyl group which may have a substituent, or a C1-C6 alkoxy group which may have a substituent.

(2-1)

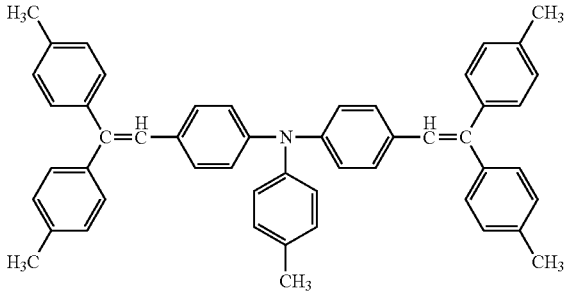

(2-2)

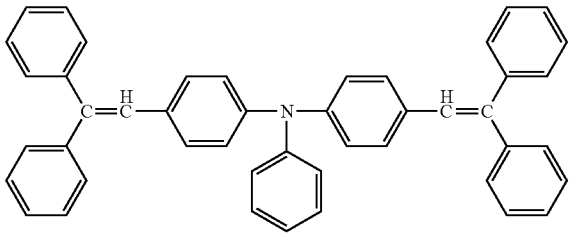

(2-3)

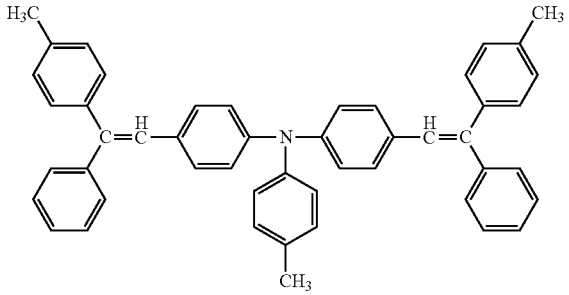

(2-4)

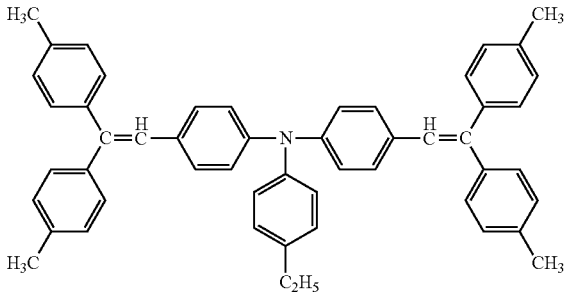

(2-5)

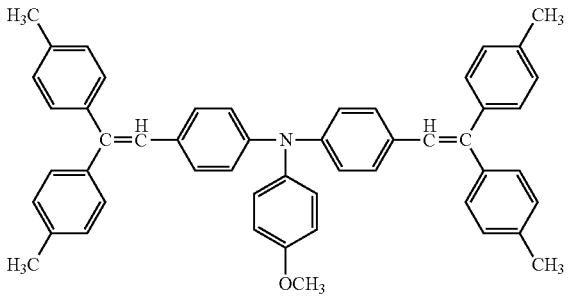

Moreover, charge transporting materials expressed by Formulas (A) to (C) are chemically stable.

(A)

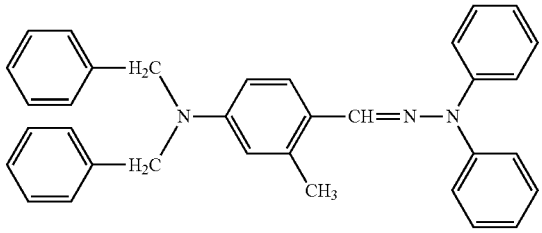

(B)

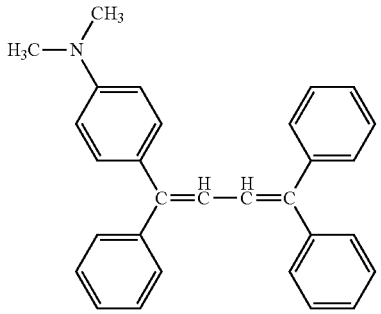

(C)

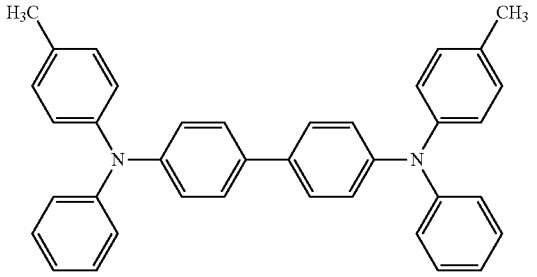

—Binder Resin—

A polymer compound usable for the binder resin is not particularly limited and may be appropriately selected depending on the intended purpose. Examples of the polymer compound include thermoplastic or thermosetting resins such as polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyarylate resins, polycarbonates, cellulose acetate resins, ethyl cellulose resins, polyvinyl butyrals, polyvinyl formals, polyvinyl toluenes, acrylic resins, silicone resins, fluororesins, epoxy resins, melamine resins, urethane resins, phenol resins and alkyd resins. The above polymer compounds may be used alone or as a mixture of two or more of them. Alternatively, they can be copolymerized with a charge transporting material in use.

A material usable as the charge transporting material copolymerized with the binder resin is, for example, the above-listed low-molecular-weight electron transporting compounds and hole transporting compound.

The amount of the charge transporting material used is about 20 parts by mass to about 200 parts by mass, preferably about 50 parts by mass to about 100 parts by mass, per 100 parts by mass of the polymer compound.

—Solvent—

Examples of the solvent include: ketons such as methyl ethyl ketone, acetone, methyl isobutyl ketone and cyclohexanone; ethers such as dioxane, tetrahydrofuran and ethyl cellosolve; aromatic compounds such as toluene and xylene; halogen-containing compounds such as chlorobenzene and dichloromethane; and esters such as ethyl acetate and butyl acetate.

—Thickness of the Charge Transport Layer—

The thickness of the charge transport layer is preferably adjusted to fall within a range of 10 μm to 30 μm, more preferably 15 μm to 25 μm. When the thickness of the charge transport layer is smaller than 10 μm, there may be a case where chargeability is not sufficient. Whereas when it is larger than 30 μm, an increased number of charges are diffused in the course of transportation of holes, resulting in degraded resolution. The reason why the range of 15 μm to 25 μm is more preferred is because a favorable balance between chargeability and resolution is attained.

(Electrophotographic Apparatus)

An electrophotographic apparatus of the present invention includes an electrophotographic photoconductor, a charging unit, an exposing unit, a developing unit, a cleaning unit and a transfer unit; and, if necessary, further includes other units.

The electrophotographic photoconductor in the electrophotographic apparatus is the above-described electrophotographic photoconductor of the present invention.

Figure 2:
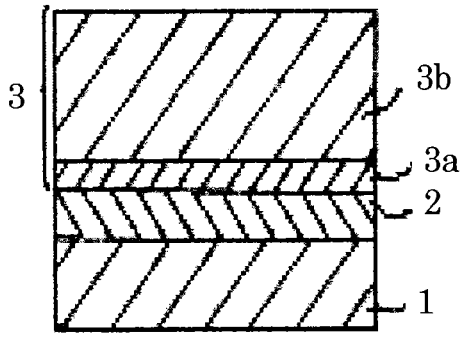
FIG. 2 is a schematic cross-sectional view of another exemplary structure of an electrophotographic photoconductor of the present invention.

Here, FIGS. 1 and 2 are each a schematic view of one example of the electrophotographic photoconductor of the present invention.

FIG. 1 is a schematic cross-sectional view of one exemplary structure of the electrophotographic photoconductor of the present invention, where the electrophotographic photoconductor is composed of an electroconductive substrate 1, an intermediate layer 2 and a photoconductive layer 3.

FIG. 2 is a schematic cross-sectional view of another exemplary structure of the electrophotographic photoconductor of the present invention, where the electrophotographic photoconductor is composed of an electroconductive substrate 1, an intermediate layer 2 and a photoconductive layer 3 and the photoconductive layer 3 is composed of a charge generation layer 3*a* and a charge transport layer 3*b*.

Figure 3:
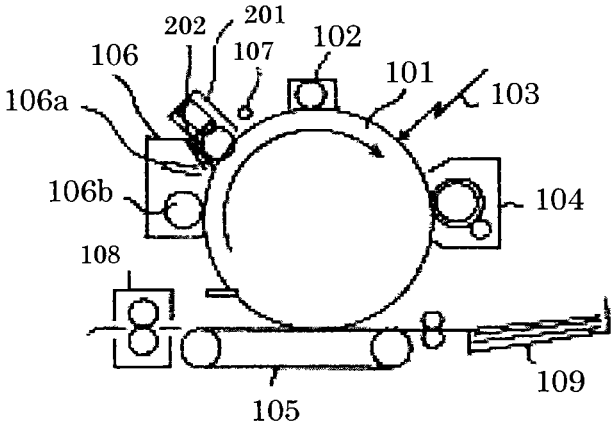
FIG. 3 is a schematic configuration diagram of one example of an electrophotographic apparatus of the present invention.

FIG. 3 is a schematic configuration diagram of one example of the electrophotographic apparatus of the present invention.

In FIG. 3, the electrophotographic apparatus includes an electrophotographic photoconductor (photoconductor) 101, a charging unit (charging device) 102, an exposing unit (imagewise exposing system) 103, a developing unit (developing device) 104 and a transfer unit (transfer device) 105.

In this configuration, a lubricant-supplying unit 201 is provided which is configured to supply a lubricant 202 to the photoconductor 101.

When image formation is performed with the above electrophotographic apparatus, first, a voltage of (±) 400 V to 1,400 V is applied to the photoconductor 101 from the charging device (contact-type charging device of a roller shape in FIG. 3) 102, so that the photoconductor is charged.

After the photoconductor 101 has been given charges (i.e., has been charged) through charging, a latent image is formed by the imagewise exposing system 103.

A document image is read by a CCD (charge-coupled device) and the read document image is converted to digital signals for a LD or LED of 400 nm to 780 nm and imaged on the photoconductor. From the viewpoint of downsizing of the electrophotographic apparatus and compatibility to the above charge transporting material, a LED having a light emission wavelength of 780 nm is preferably used as a writing light source.

Through imaging, charge separation occurs in the photoconductive layer to form a latent image on the photoconductor 101. The photoconductor 101, on which the latent image has been formed correspondingly to the document image, is subjected to development by a one-component developer with the developing device 104, whereby a visible image (toner image) of the document image is obtained.

Next, the toner image on the photoconductor 101 is transferred onto a copier paper sheet 109, which is fed by the transfer device 105, and conveyed to a fixing device 108 where a hard copy is formed.

The photoconductor 101 from which the toner image has been transferred is cleaned by a cleaning device 106 (composed of a cleaning brush 106*b* and an elastic rubber cleaning blade 106*a*) so that the residual toner image is removed therefrom.

The photoconductor after cleaning still retains at least part of the latent image (document image) on which the formation of the toner image has been based. Thus, the photoconductor is charge-eliminated by a charge-eliminating device (in which red light is generally used) 107 for erasing the latent image to give a uniform surface. In this manner, a copying process including treatments for the next latent image formation is completed.

Even when repetitively used, the electrophotographic apparatus containing the electrophotographic photoconductor of the present invention involves delayed charging and increase in residual potential to a lesser extent. In addition, abnormal images such as black spots are hardly formed on the image obtained.

Furthermore, the electrophotographic photoconductor is not degraded very much even after repetitively used, making it possible to form high-quality images stably over a long period of time.

(Process Cartridge)

A process cartridge of the present invention includes an electrophotographic photoconductor (photoconductor) and includes a charging unit, an exposing unit, a developing unit, a cleaning unit or a transfer unit or any combination of these units; and, if necessary, further includes other units.

The electrophotographic photoconductor in the process cartridge is the above-described electrophotographic photoconductor of the present invention.

The above electrophotographic apparatus may be fixedly incorporated into a copier, a facsimile or a printer, or may be incorporated thereinto in the form of the process cartridge.

The process cartridge can make the electrophotographic apparatus small, and also simple and steady maintenance is possible. In addition, replacement of the part can be easy to perform. The process cartridge does not involve increase in residual potential, making it possible to form high-quality images free of black spots over a long period of time.

EXAMPLES

The present invention will next be described by way of Examples, which should not be construed as limiting the present invention thereto. In Examples, the unit "part(s)" means "part(s) by mass."

Example 1

An electrophotographic photoconductor (photoconductor) of Example 1 was produced by sequentially forming an intermediate layer, a charge generation layer and a charge transport layer on an aluminum substrate according to the following procedure.

(Coating Liquid for an Intermediate Layer)

A 200 mL-mayonnaise bottle was charged with 18.7 parts of an inorganic pigment which is titanium oxide whose surface is treated with aluminum hydroxide (specific surface area: 85 $m^2/g$, content of titanium oxide: 83% by mass), 6.1 parts of a binder resin which is a polyamide copolymer (AMMAN CM8000 (product of TORAY INDUSTRIES, Co., Ltd.), a dispersion solvent which is a mixture of 70 mL of methanol and 30 mL of propanol, and 50 mL of a dispersion medium which is zirconia balls PTZ 0.6 mm in diameter. The resultant mixture was dispersed with a paint shaker for 15 hours. After dispersion, 35 mL of methanol and 15 mL of propanol were added to the bottle, followed by stirring for about 1 hour. The dispersion medium was filtered off to prepare a coating liquid for an intermediate layer.

(Formation of an Intermediate Layer)

The coating liquid for an intermediate layer was coated by a dip coating method on an aluminum substrate 30 mm in diameter and 0.8 mm in thickness and an aluminum substrate 24 mm in diameter and 0.8 mm in thickness, followed by drying at 135° C. for 20 min, to thereby form an intermediate layer having a thickness of 2 μm. The volume ratio of the inorganic pigment of the formed intermediate layer is as follows.

Volume of the inorganic pigment $Vf$=18.7/4.2=4.452

Volume of the binder resin $Vr$=6.1/1.12=5.446

Volume ratio of the inorganic pigment=4.452/(4.452+5.446)=45%

The intermediate layer was found to have a volume resistivity of $1.2\times10^{12}$ Ω·cm.

(Production of a Charge Generating Agent)

Titanylphthalocyanine used as a charge generating agent was produced according to the following procedure.

Specifically, 29.2 g of 1,3-diiminoisoindoline and 200 mL of sulfolane were mixed together, and 20.4 g of titanium tetrabutoxide was added dropwise to the mixture under a stream of nitrogen.

After completion of addition, the mixture was gradually increased in temperature to 180° C. and allowed to react for 5 hours under stirring with the reaction temperature kept at 170° C. to 180° C. After completion of reaction, the reaction mixture was left to cool and the precipitates that formed were separated through filtration. The obtained powder was washed with chloroform until it turned blue. Next, the resultant powder was washed with methanol several times and further washed with hot water of 80° C., followed by drying, to thereby obtain crude titanylphthalocyanine.

The crude titanylphthalocyanine was dissolved in concentrated sulfuric acid 20 times in volume. The solution was added dropwise to ice water 100 times in volume under stirring. The precipitates that formed were separated through filtration and then were washed with water repeatedly until the wash liquid became neutral, to thereby obtain a wet cake of a titanylphthalocyanine pigment.

The thus-obtained wet cake (2 g) was charged into 20 g of tetrahydrofuran and the mixture was stirred for 4 hours. Then, 100 g of methanol was added to the mixture and the mixture was stirred for 1 hour. The resultant mixture was subjected to filtration, followed by drying, to thereby titanylphthalocyanine powder used in the present invention.

The obtained titanylphthalocyanine powder was measured for X-ray diffraction spectrum under the following conditions. As a result, it was found to have the maximum peak at 27.2±0.2° and a peak at 7.3±0.2° (the smallest angle) and have no peak in the range of 7.4° to 9.4° and no peak at 26.3° as Bragg angles 2θ with respect to Cu-Kα rays (wavelength: 1.542 angstroms).

(Formation of a Charge Generation Layer)

The obtained titanylphthalocyanine pigment (15 g), 8 g of polyvinyl butyral (S-LEC BX-1: product of SEKISUI CHEMICAL CO., LTD.) and 500 g of methyl ethyl ketone were dispersed through beads milling so that the average particle diameter of the pigment was adjusted to 0.2 μm, to thereby prepare a coating liquid for a charge generation layer. The thus-prepared coating liquid for a charge generation layer was coated by a dip coating method.

(Formation of a Charge Transport Layer)

Polycarbonate (IUPILON Z200: MITSUBISHI GAS CHEMICAL COMPANY, LTD.) (10 parts) and 8 parts of a charge transporting material expressed by the following Formula (1-1) were dissolved in 80 parts of tetrahydrofuran, to thereby prepare a coating liquid for a charge transport layer. Subsequently, the coating liquid for a charge transport layer was coated on the above-formed charge generation layer and dried at 125° C. for 20 min to form a charge transport layer having a thickness of 23 μm, whereby an electrophotographic photoconductor was produced.

(1-1)

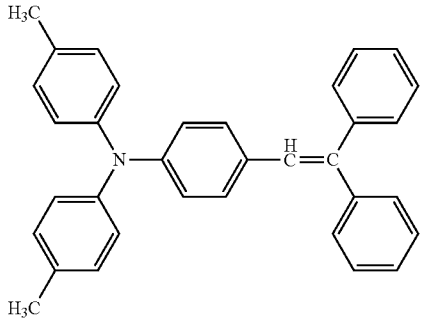

Example 2

An electrophotographic photoconductor was produced in the same manner as in Example 1 except that the amount of the inorganic pigment for the intermediate layer was changed to 9.80 g (the volume ratio of the inorganic pigment: 30%). The intermediate layer was found to have a volume resistivity of $5.0\times10^{12}$ Ω·cm.

Example 3

An electrophotographic photoconductor was produced in the same manner as in Example 1 except that the amount of the inorganic pigment for the intermediate layer was changed to 22.9 g (the volume ratio of the inorganic pigment: 50%). The intermediate layer was found to have a volume resistivity of $6.0\times10^{11}$ Ω·cm.

Example 4

An electrophotographic photoconductor was produced in the same manner as in Example 1 except that the inorganic pigment for the intermediate layer was changed to titanium oxide whose surface had been treated with aluminum hydroxide (specific surface area: 70 $m^2$/g, content of titanium oxide: 80% by mass). The intermediate layer was found to have a volume resistivity of $6.0\times10^{11}$ Ω·cm.

Example 5

An electrophotographic photoconductor was produced in the same manner as in Example 1 except that the inorganic pigment for the intermediate layer was changed to titanium oxide whose surface had been treated with aluminum hydroxide (specific surface area: 140 $m^2$/g, content of titanium oxide: 75% by mass). The intermediate layer was found to have a volume resistivity of $8.0\times10^{12}$ Ω·cm.

Example 6

An electrophotographic photoconductor was produced in the same manner as in Example 1 except that the inorganic pigment for the intermediate layer was changed to titanium oxide whose surface had been treated with aluminum hydroxide (specific surface area: 80 $m^2$/g, content of titanium oxide: 70% by mass). The intermediate layer was found to have a volume resistivity of $9.0\times10^{12}$ Ω·cm.

Example 7

An electrophotographic photoconductor was produced in the same manner as in Example 1 except that the inorganic pigment for the intermediate layer was changed to titanium oxide whose surface had been treated with aluminum hydroxide (specific surface area: 75 $m^2$/g, content of titanium oxide: 90% by mass). The intermediate layer was found to have a volume resistivity of $5.0\times10^{11}$ Ω·cm.

Example 8

An electrophotographic photoconductor was produced in the same manner as in Example 1 except that the charge transporting material expressed by Formula (1-1) was changed to a charge transporting material expressed by Formula (1-2).

Example 9

An electrophotographic photoconductor was produced in the same manner as in Example 1 except that the charge transporting material expressed by Formula (1-1) was changed to a charge transporting material expressed by Formula (1-3).

Example 10

An electrophotographic photoconductor was produced in the same manner as in Example 1 except that the charge transporting material expressed by Formula (1-1) was changed to a charge transporting material expressed by Formula (1-4).

Example 11

An electrophotographic photoconductor was produced in the same manner as in Example 1 except that the charge transporting material expressed by Formula (1-1) was changed to a charge transporting material expressed by Formula (1-5).

Example 12

An electrophotographic photoconductor was produced in the same manner as in Example 1 except that the charge transporting material expressed by Formula (1-1) was changed to a charge transporting material expressed by Formula (2-1).

Example 13

An electrophotographic photoconductor was produced in the same manner as in Example 1 except that the charge transporting material expressed by Formula (1-1) was changed to a charge transporting material expressed by Formula (2-2).

Example 14

An electrophotographic photoconductor was produced in the same manner as in Example 1 except that the charge transporting material expressed by Formula (1-1) was changed to a charge transporting material expressed by Formula (2-3).

Example 15

An electrophotographic photoconductor was produced in the same manner as in Example 1 except that the charge transporting material expressed by Formula (1-1) was changed to a charge transporting material expressed by Formula (2-4).

Example 16

An electrophotographic photoconductor was produced in the same manner as in Example 1 except that the charge transporting material expressed by Formula (1-1) was changed to a charge transporting material expressed by Formula (2-5).

Example 17

An electrophotographic photoconductor was produced in the same manner as in Example 1 except that the thickness of the charge transport layer was changed from 23 μm to 25 μm.

Example 18

An electrophotographic photoconductor was produced in the same manner as in Example 1 except that the thickness of the charge transport layer was changed from 23 μm to 15 μm.

Example 19

An electrophotographic photoconductor was produced in the same manner as in Example 1 except that the charge transporting material expressed by Formula (1-1) was changed to a charge transporting material expressed by Formula (A).

(A)

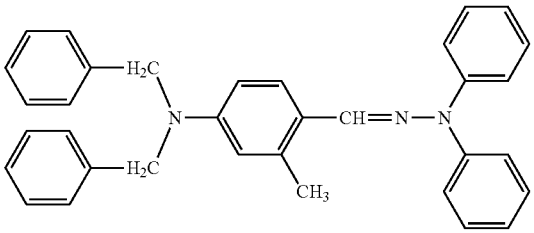

Example 20

An electrophotographic photoconductor was produced in the same manner as in Example 1 except that the charge transporting material expressed by Formula (1-1) was changed to a charge transporting material expressed by Formula (B).

(B)

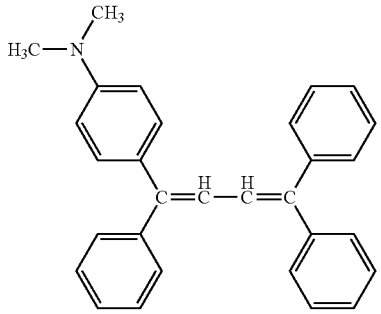

Example 21

An electrophotographic photoconductor was produced in the same manner as in Example 1 except that the charge transporting material expressed by Formula (1-1) was changed to a charge transporting material expressed by Formula (C).

(C)

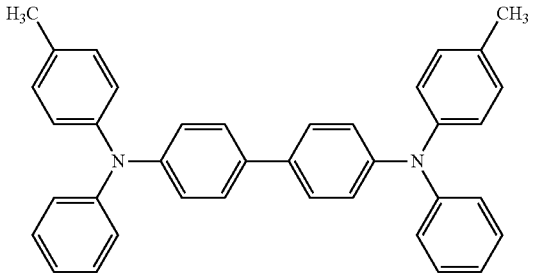

Comparative Example 1

An electrophotographic photoconductor was produced in the same manner as in Example 1 except that the amount of the inorganic pigment for the intermediate layer was changed to 7.62 g (the volume ratio of the inorganic pigment: 25%). The intermediate layer was found to have a volume resistivity of $1.2\times10^{13}$ Ω·cm.

Comparative Example 2

An electrophotographic photoconductor was produced in the same manner as in Example 1 except that the amount of the inorganic pigment for the intermediate layer was changed to 28.0 g (the volume ratio of the inorganic pigment: 55%). The intermediate layer was found to have a volume resistivity of $3.0\times10^{11}$ Ω·cm.

Comparative Example 3

An electrophotographic photoconductor was produced in the same manner as in Example 2 except that the inorganic pigment for the intermediate layer was changed to titanium oxide which had not been treated (specific surface area: 85

$m^2/g$, content of titanium oxide: 98% by mass). The intermediate layer was found to have a volume resistivity of $7.0\times10^{10}$ Ω·cm.

Comparative Example 4

An electrophotographic photoconductor was produced in the same manner as in Example 3 except that the inorganic pigment for the intermediate layer was changed to titanium oxide which had not been treated (specific surface area: 85 $m^2/g$, content of titanium oxide: 98% by mass). The intermediate layer was found to have a volume resistivity of $3.0\times10^{10}$ Ω·cm.

Comparative Example 5

An electrophotographic photoconductor was produced in the same manner as in Example 1 except that the inorganic pigment for the intermediate layer was changed to titanium oxide whose surface had been treated with aluminum hydroxide (specific surface area: 45 $m^2/g$, content of titanium oxide: 93% by mass). The intermediate layer was found to have a volume resistivity of $2.0\times10^{11}$ Ω·cm.

Comparative Example 6

An electrophotographic photoconductor was produced in the same manner as in Example 2 except that the inorganic pigment for the intermediate layer was changed to titanium oxide whose surface had been treated with aluminum hydroxide (specific surface area: 45 $m^2/g$, content of titanium oxide: 93% by mass). The intermediate layer was found to have a volume resistivity of $3.0\times10^{11}$ Ω·cm.

Comparative Example 7

An electrophotographic photoconductor was produced in the same manner as in Example 1 except that the inorganic pigment for the intermediate layer was changed to titanium oxide whose surface had been treated with octyl silane (specific surface area: 80 $m^2/g$, content of titanium oxide: 90% by mass). The intermediate layer was found to have a volume resistivity of $6.0\times10^{10}$ Ω·cm.

Comparative Example 8

An electrophotographic photoconductor was produced in the same manner as in Example 1 except that the inorganic pigment for the intermediate layer was changed to titanium oxide whose surface had been treated sequentially with aluminum hydroxide, silica and silicone in this order (specific surface area: 90 $m^2/g$, content of titanium oxide: 80% by mass). The intermediate layer was found to have a volume resistivity of $3.0\times10^{13}$Ω·cm.

Comparative Example 9

An electrophotographic photoconductor was produced in the same manner as in Example 1 except that the inorganic pigment for the intermediate layer was changed to titanium oxide whose surface had been treated with aluminum hydroxide (specific surface area: 160 $m^2/g$, content of titanium oxide: 88% by mass). The intermediate layer was found to have a volume resistivity of $5.0\times10^{11}$ Ω·cm.

Comparative Example 10

An electrophotographic photoconductor was produced in the same manner as in Example 1 except that the binder resin for the intermediate layer was changed to methylmethoxylated 6 polyamides FR-101 (product of NAMARIICHI CO., LTD.). The intermediate layer was found to have a volume resistivity of $8.0\times10^{10}$ Ω·cm.

Comparative Example 11

An electrophotographic photoconductor was produced in the same manner as in Example 1 except that a coating liquid for an intermediate layer was prepared by dispersing the same materials at the same compositional ratios using CLEARMIX CLS-1.5S (product of M Technique Co., Ltd.) for 1 hour. The intermediate layer was found to have a volume resistivity of $3.0\times10^{10}$ Ω·cm.

Table 1 presents the specific surface area and the content of titanium oxide of the inorganic pigment used in the intermediate layer, the volume ratio of the inorganic pigment in the intermediate layer, the volume resistivity of the intermediate layer in each of the electrophotographic photoconductors produced in Examples 1 to 21 and Comparative Examples 1 to 11.

TABLE 1

| | Inorganic pigment | | Intermediate layer | |
|---|---|---|---|---|
| | Specific surface area ($m^2/g$) | Content of titanium oxide (% by mass) | Volume ratio of inorganic pigment (% by volume) | Volume resistivity (Ω · cm) |
| Ex. 1 | 85 | 83 | 45 | $1.2\times10^{12}$ |
| Ex. 2 | 85 | 83 | 30 | $5.0\times10^{12}$ |
| Ex. 3 | 85 | 83 | 50 | $6.0\times10^{11}$ |
| Ex. 4 | 70 | 80 | 45 | $6.0\times10^{11}$ |
| Ex. 5 | 140 | 75 | 45 | $8.0\times10^{12}$ |
| Ex. 6 | 80 | 70 | 45 | $9.0\times10^{12}$ |
| Ex. 7 | 75 | 90 | 45 | $5.0\times10^{11}$ |
| Ex. 8 | 85 | 83 | 45 | $1.2\times10^{12}$ |
| Ex. 9 | 85 | 83 | 45 | $1.2\times10^{12}$ |
| Ex. 10 | 85 | 83 | 45 | $1.2\times10^{12}$ |
| Ex. 11 | 85 | 83 | 45 | $1.2\times10^{12}$ |
| Ex. 12 | 85 | 83 | 45 | $1.2\times10^{12}$ |
| Ex. 13 | 85 | 83 | 45 | $1.2\times10^{12}$ |
| Ex. 14 | 85 | 83 | 45 | $1.2\times10^{12}$ |
| Ex. 15 | 85 | 83 | 45 | $1.2\times10^{12}$ |
| Ex. 16 | 85 | 83 | 45 | $1.2\times10^{12}$ |
| Ex. 17 | 85 | 83 | 45 | $1.2\times10^{12}$ |
| Ex. 18 | 85 | 83 | 45 | $1.2\times10^{12}$ |
| Ex. 19 | 85 | 83 | 45 | $1.2\times10^{12}$ |
| Ex. 20 | 85 | 83 | 45 | $1.2\times10^{12}$ |
| Ex. 21 | 85 | 83 | 45 | $1.2\times10^{12}$ |
| Comp. Ex. 1 | 85 | 83 | 25 | $1.2\times10^{13}$ |
| Comp. Ex. 2 | 85 | 83 | 55 | $3.0\times10^{11}$ |
| Comp. Ex. 3 | 85 | 98 | 30 | $7.0\times10^{10}$ |
| Comp. Ex. 4 | 85 | 98 | 50 | $3.0\times10^{10}$ |
| Comp. Ex. 5 | 45 | 93 | 45 | $2.0\times10^{11}$ |
| Comp. Ex. 6 | 45 | 93 | 30 | $3.0\times10^{11}$ |
| Comp. Ex. 7 | 80 | 90 (treated with octyl silane) | 45 | $6.0\times10^{10}$ |
| Comp. Ex. 8 | 90 | 83 (treated with aluminum hydroxide, silica and silicone) | 45 | $3.0\times10^{13}$ |
| Comp. Ex. 9 | 160 | 88 | 45 | $5.0\times10^{11}$ |
| Comp. Ex. 10 | 85 | 83 | 45 | $8.0\times10^{10}$ |
| Comp. Ex. 11 | 85 | 83 | 45 | $3.0\times10^{10}$ |

[Evaluation Method]

(Evaluation of Electrostatic Characteristics Before and after a Fatigue Test)

Using an evaluation device for electrophotographic photoconductors (product of Yamanashi Electronics Co., Ltd.), each of the electrophotographic photoconductors produced in Examples and Comparative Examples was measured for surface potential (V0) when a discharge current of 25 μA was applied to the electrophotographic photoconductor with a scorotron under an environment of 23° C. and humidity 50% (N/N). Thereafter, the discharge current was adjusted so that the surface potential became −700 V and then the surface of the electrophotographic photoconductor was irradiated with beams from a laser diode of 780 nm in wavelength, to thereby measure an exposed light energy when the surface potential was attenuated to ½ (−350 V); i.e., an exposed light energy for half reduction (E½). Also, the surface potential of the electrophotographic photoconductor when irradiated with exposure energy at 1.0 μJ/cm$^2$ was defined as residual potential (VL), and the residual potential (VL) was measured before and after 1,000 cycles of fatigue. The difference in the surface potential V0 before and after the fatigue test was calculated from the following equation:

$$(V0 \text{ before the fatigue test})-(V0 \text{ after the fatigue test})=\Delta V0.$$

Similarly, the difference in the residual potential VL before and after the fatigue test was calculated from the following equation:

$$(VL \text{ before the fatigue test})-(VL \text{ after the fatigue test})=\Delta VL.$$

(Evaluation of Black Spots or Dust Particles)

Each electrophotographic photoconductor was mounted to an electrophotographic apparatus illustrated in FIG. 3 (IMAGIO MP C2200, product of Ricoh Company, Ltd.). The electrophotographic apparatus was subjected to a paper feeding test in which 300,000 sheets of A4-size PPC paper were fed to the electrophotographic apparatus so that the shorter side of each paper entered the electrophotographic apparatus. The electrophotographic apparatus was caused to output a solid white image, where the number of black spots or dust particles was visually measured for image evaluation.

<Evaluation Criteria>

A: No black spots were formed at every cycle of the drum.

B: Black spots were formed at every cycle of the drum.

(Evaluation of Resolution)

The electrophotographic apparatus illustrated in FIG. 3 was used, similar to the evaluation of black spots or dust particles, to output 8 different image patterns having 1 to 8 thin lines in a portion with a width of 1 mm.

<Evaluation Criteria>

A: It was possible to form the image patterns having 6 or more thin lines in a portion with a width of 1 mm.

B: It was possible to form the image pattern having 5 thin lines in a portion with a width of 1 mm.

C: It was possible to form the image patterns having 4 or less thin lines in a portion with a width of 1 mm.

(Evaluation of Image Moiré)

The electrophotographic apparatus illustrated in FIG. 3 (IMAGIO MP C220, product of Ricoh Company, Ltd.), which performs development with a one-component developer, was used after the writing light source LD thereof had been replaced with a LED of 780 nm in wavelength. The electrophotographic apparatus was caused to print out a halftone pattern, to thereby evaluate whether moiré pattern was observed or not at every cycle of the drum.

<Evaluation Criteria>

A: No moiré pattern was observed at every cycle of the drum.

B: Moiré pattern was observed at every cycle of the drum.

(Evaluation of Change in the Film Thickness (the Thickness of the Charge Transport Layer))

An eddy current contact thickness meter FISCHERSCOPE MMS (product of FISCHERSCOPEINSTRUMENTS LTD.) was used to measure the film thicknesses at the center of the drum and at 6 points on the circumferential surface of the drum. The measured film thicknesses were used to determine a change in film thickness.

(Evaluation of Stability as Liquid)

Each (10 mL) of the coating liquids for an intermediate layer was placed in a test tube, which was left to stand in darkness for 1 month. The stability as liquid was evaluated by measuring the range L (mL) (or width) of the test tube over which the pigment sedimented at the bottom thereof.

<Evaluation Criteria>

A: L≤0.1 mL (good dispersion state)

B: 0.1 mL<L≤0.5 mL

C: 0.5 mL<L (poor dispersion state)

The evaluation results are presented in Tables 2-1 and 2-2.

TABLE 2-1

| | Characteristics before fatigue | | Difference after fatigue | | E1/2 |
|---|---|---|---|---|---|
| | V0 (−V) | VL (−V) | ΔV0 (V) | ΔVL (V) | μJ/cm$^2$ |
| Ex. 1 | 700 | 40 | −12 | −5 | 0.10 |
| Ex. 2 | 705 | 49 | −13 | −8 | 0.10 |
| Ex. 3 | 712 | 33 | −19 | −5 | 0.10 |
| Ex. 4 | 695 | 32 | −14 | −6 | 0.10 |
| Ex. 5 | 698 | 55 | −18 | −17 | 0.10 |
| Ex. 6 | 705 | 58 | −20 | −25 | 0.10 |
| Ex. 7 | 719 | 42 | −15 | −5 | 0.10 |
| Ex. 8 | 699 | 55 | −15 | −5 | 0.10 |
| Ex. 9 | 690 | 54 | −14 | −7 | 0.10 |
| Ex. 10 | 699 | 49 | −12 | −10 | 0.11 |
| Ex. 11 | 703 | 50 | −19 | −9 | 0.11 |
| Ex. 12 | 701 | 25 | −29 | −3 | 0.09 |
| Ex. 13 | 694 | 26 | −26 | −4 | 0.09 |
| Ex. 14 | 692 | 25 | −26 | −3 | 0.10 |
| Ex. 15 | 699 | 32 | −23 | −5 | 0.10 |
| Ex. 16 | 695 | 33 | −20 | −5 | 0.10 |
| Ex. 17 | 715 | 59 | −8 | −5 | 0.10 |
| Ex. 18 | 670 | 39 | −25 | −10 | 0.13 |
| Ex. 19 | 689 | 49 | −68 | −20 | 0.12 |
| Ex. 20 | 699 | 55 | −41 | −21 | 0.12 |
| Ex. 21 | 702 | 40 | −48 | −11 | 0.11 |
| Comp. Ex. 1 | 719 | 58 | −21 | −43 | 0.10 |
| Comp. Ex. 2 | 705 | 34 | 35 | −3 | 0.10 |
| Comp. Ex. 3 | 696 | 33 | 44 | 5 | 0.10 |
| Comp. Ex. 4 | 686 | 20 | 52 | 5 | 0.10 |
| Comp. Ex. 5 | 693 | 25 | 33 | 3 | 0.10 |
| Comp. Ex. 6 | 685 | 42 | 29 | 4 | 0.10 |
| Comp. Ex. 7 | 683 | 38 | 45 | 5 | 0.10 |
| Comp. Ex. 8 | 715 | 62 | −49 | −48 | 0.11 |
| Comp. Ex. 9 | 721 | 59 | −19 | −19 | 0.11 |
| Comp. Ex. 10 | 685 | 34 | 33 | 10 | 0.10 |
| Comp. Ex. 11 | 653 | 23 | 52 | 8 | 0.09 |

TABLE 2-2

| | Image evaluation | | | | |
|---|---|---|---|---|---|
| | Black spots or dust particles | Resolution | Moiré | Change in film thickness (μm) | Stability as liquid |
| Ex. 1 | A | B | A | 7.0 | A |
| Ex. 2 | A | B | A | 7.1 | A |
| Ex. 3 | A | B | A | 7.0 | A |
| Ex. 4 | A | B | A | 6.9 | A |
| Ex. 5 | A | B | A | 7.3 | A |
| Ex. 6 | A | B | A | 7.2 | A |
| Ex. 7 | A | B | A | 6.8 | A |
| Ex. 8 | A | B | A | 7.2 | A |
| Ex. 9 | A | B | A | 7.3 | A |
| Ex. 10 | A | B | A | 7.0 | A |
| Ex. 11 | A | B | A | 6.7 | A |
| Ex. 12 | A | B | A | 7.5 | A |
| Ex. 13 | A | B | A | 7.6 | A |
| Ex. 14 | A | B | A | 7.4 | A |
| Ex. 15 | A | B | A | 7.8 | A |
| Ex. 16 | A | B | A | 7.6 | A |
| Ex. 17 | A | B | A | 6.9 | A |
| Ex. 18 | A | A | A | 6.7 | A |
| Ex. 19 | A | B | A | 8.4 | A |
| Ex. 20 | A | B | A | 6.4 | A |
| Ex. 21 | A | B | A | 8.9 | A |
| Comp. Ex. 1 | A | B | A | 7.3 | A |
| Comp. Ex. 2 | B | B | A | 7.2 | B |
| Comp. Ex. 3 | B | B | A | 7.2 | A |
| Comp. Ex. 4 | B | B | B | 7.0 | A |
| Comp. Ex. 5 | B | B | B | 7.1 | A |
| Comp. Ex. 6 | B | B | A | 6.9 | A |
| Comp. Ex. 7 | B | B | A | 7.1 | A |
| Comp. Ex. 8 | A | B | A | 6.9 | A |
| Comp. Ex. 9 | A | B | B | 6.8 | C |
| Comp. Ex. 10 | B | B | A | 7.1 | A |
| Comp. Ex. 11 | B | B | A | 7.2 | C |

As is clear from Tables 2-1 and 2-2, the photoconductors of the present invention are excellent in terms of all of the electrical characteristics before fatigue, change in potential after fatigue, presence or absence of the black spots/dust particles after printing of the 300,000 paper sheets, presence or absence of moiré, and stability as liquid. The thickness of the charge transport layer of the photoconductor produced in Example 18 was originally 15 μm but decreased to about 8 μm after printing of 300,000 paper sheets. Nevertheless, neither black spots nor dust particles were formed by this photoconductor, indicating that use of the photoconductor (electrophotographic process) of the present invention achieves stable image formation over a long period of time.

In contrast, the photoconductor of Comparative Example 1, where the volume ratio of the inorganic pigment and the volume resistivity do not fall within the corresponding ranges defined in the present invention, is insufficient in durability since the difference in electrical characteristics before and after the fatigue test is large.

Also, the photoconductor of Comparative Example 2, where the volume ratio of the inorganic pigment and the volume resistivity do not fall within the corresponding ranges defined in the present invention, does not exhibit sufficient characteristics since the stability of the coating liquid is poor and black spots or dust particles are observed in image evaluation.

The photoconductors of Comparative Examples 3 and 4, where the content of the titanium oxide of the inorganic pigment and the volume resistivity do not fall within the corresponding ranges defined in the present invention, do not have satisfactory qualities since the potential considerably decreases after the fatigue test and black spots or dust particles are observed in image evaluation.

The photoconductors of Comparative Examples 5 and 6, where the content of the titanium oxide of the inorganic pigment, the specific surface area and the volume resistivity do not fall within the corresponding ranges defined in the present invention, do not have satisfactory qualities since black spots or dust particles are observed. The photoconductor of Comparative Example 5 also involves moiré formation.

The photoconductor of Comparative Example 7, where the volume resistivity does not fall within the range defined in the present invention, did not have satisfactory qualities since black spots or dust particles are observed.

The photoconductor of Comparative Example 8, where the volume resistivity does not fall within the range defined in the present invention, is insufficient in durability since the difference in electrical characteristics before and after the fatigue test is large.

The photoconductor of Comparative Example 9, where the specific surface area does not fall within the range defined in the present invention, cannot consistently be produced since it involves moiré formation and the stability as liquid is poor.

The photoconductor of Comparative Example 10, where the volume resistivity does not fall within the range defined in the present invention, does not have satisfactory qualities since black spots or dust particles are observed in image evaluation.

The photoconductor of Comparative Example 11, where the volume resistivity does not fall within the range defined in the present invention, involves formation of black spots or dust particles in image evaluation and the stability as liquid becomes poor.

As described above, the present invention can provide high image quality, highly durable photoconductors and stability as liquid.

Embodiments of the present invention are as follows.

<1> An electrophotographic photoconductor including:

an electroconductive substrate;

an intermediate layer; and a photoconductive layer, the intermediate layer and the photoconductive layer being on the electroconductive substrate, wherein the intermediate layer includes an inorganic pigment and a binder resin, wherein a volume ratio of the inorganic pigment in the intermediate layer is 30% by volume to 50% by volume, wherein the inorganic pigment includes titanium oxide and a content of the titanium oxide in the inorganic pigment is 70% by mass to 90% by mass, wherein the inorganic pigment has a specific surface area of 70 $m^2/g$ to 140 $m^2/g$, and wherein the intermediate layer has a volume resistivity at an electrical field intensity of $2.5\times10^5$ V/cm of $5\times10^{11}$ Ω·cm to $1\times10^{13}$ Ω·cm.

<2> The electrophotographic photoconductor according to <1>, wherein the titanium oxide in the inorganic pigment is treated with aluminum hydroxide, and the other ingredients in the inorganic pigment than the titanium oxide are derived from the treatment with aluminum hydroxide.

<3> The electrophotographic photoconductor according to <1> or <2>, wherein the binder resin is a polyamide copolymer resin.

<4> The electrophotographic photoconductor according to any one of <1> to <3>, wherein the photoconductive layer includes a charge generation layer and a charge transport layer, and wherein the charge transport layer includes a charge transporting material represented by the following General Formula (1):

General Formula (1)

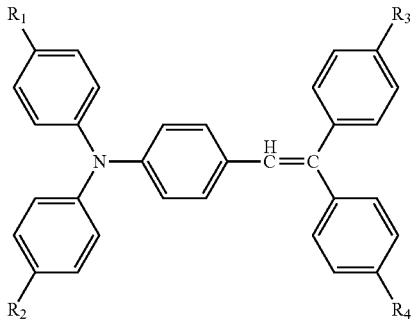

where $R_1$ to $R_4$ each independently represent hydrogen, a C1-C6 alkyl group which may have a substituent, or a C1-C6 alkoxy group which may have a substituent.

<5> The electrophotographic photoconductor according to <4>, wherein the charge transporting material represented by the General Formula (1) is a charge transporting material expressed by the following Formula (1-1):

(1-1)

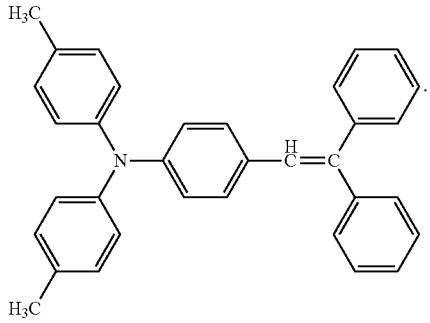

<6> The electrophotographic photoconductor according to any one of <1> to <3>, wherein the photoconductive layer includes a charge generation layer and a charge transport layer, and wherein the charge transport layer includes a charge transporting material represented by the following General Formula (2):

General Formula (2)

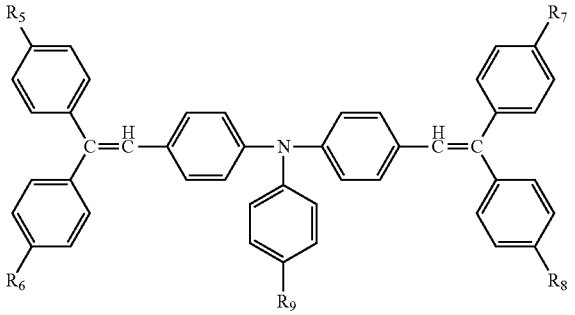

where $R_5$ to $R_9$ each independently represent hydrogen, a C1-C6 alkyl group which may have a substituent, or a C1-C6 alkoxy group which may have a substituent.

<7> The electrophotographic photoconductor according to <6>, wherein the charge transporting material represented by the General Formula (2) is a charge transporting material expressed by the following Formula (2-1):

(2-1)

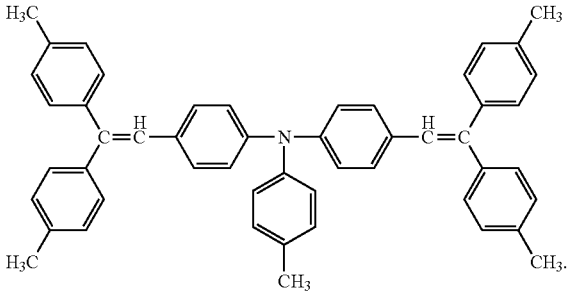

<8> An electrophotographic apparatus including:

an electrophotographic photoconductor;

a charging unit;

an exposing unit;

a developing unit;

a cleaning unit; and a transfer unit, wherein the electrophotographic photoconductor is the electrophotographic photoconductor according to <1> to <7>.

<9> The electrophotographic apparatus according to <8>, wherein the exposing unit is a LED light source, and wherein the developing unit is a developing unit configured to perform development with a one-component developer.

<10> A process cartridge including:

an electrophotographic photoconductor; and a charging unit, an exposing unit, a developing unit, a cleaning unit or a transfer unit, or any combination thereof, wherein the electrophotographic photoconductor is the electrophotographic photoconductor according to any one of <1> to <7>.

This application claims priority to Japanese application No. 2011-277844, filed on Dec. 20, 2011, and incorporated herein by reference.

What is claimed is:

1. An electrophotographic photoconductor comprising:

an electroconductive substrate;

an intermediate layer; and a photoconductive layer, the intermediate layer and the photoconductive layer being on the electroconductive substrate, wherein the intermediate layer comprises an inorganic pigment and a binder resin, wherein a volume ratio of the inorganic pigment in the intermediate layer is 30% by volume to 50% by volume, wherein the inorganic pigment comprises titanium oxide and a content of the titanium oxide in the inorganic pigment is 70% by mass to 90% by mass, wherein the inorganic pigment has a specific surface area of 70 $m^2/g$ to 140 $m^2/g$, and wherein the intermediate layer has a volume resistivity at an electrical field intensity of $2.5\times10^5$ V/cm of $5\times10^{11}$ Ω·cm to $1\times10^{13}$ Ω·cm.

2. The electrophotographic photoconductor according to claim 1, wherein the titanium oxide in the inorganic pigment is treated with aluminum hydroxide, and the other ingredients in the inorganic pigment than the titanium oxide are derived from the treatment with aluminum hydroxide.

3. The electrophotographic photoconductor according to claim 1, wherein the binder resin is a polyamide copolymer resin.

4. The electrophotographic photoconductor according to claim 1, wherein the photoconductive layer comprises a charge generation layer and a charge transport layer, and wherein the charge transport layer comprises a charge transporting material represented by the following General Formula (1):

General Formula (1)

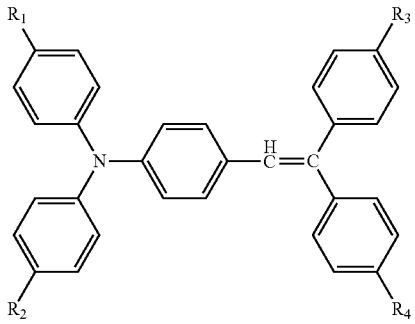

where $R_1$ to $R_4$ each independently represent hydrogen, a C1-C6 alkyl group which may have a substituent, or a C1-C6 alkoxy group which may have a substituent.

5. The electrophotographic photoconductor according to claim 4, wherein the charge transporting material represented by the General Formula (1) is a charge transporting material expressed by the following Formula (1-1):

(1-1)

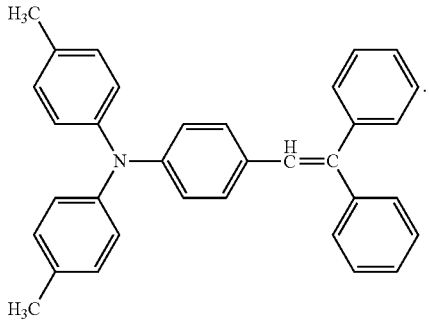

6. The electrophotographic photoconductor according to claim 1, wherein the photoconductive layer comprises a charge generation layer and a charge transport layer, and wherein the charge transport layer comprises a charge transporting material represented by the following General Formula (2):

General Formula (2)

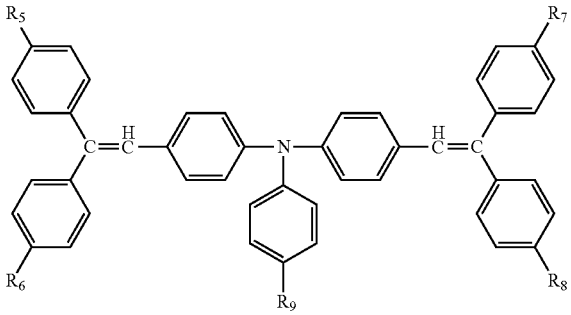

where $R_5$ to $R_9$ each independently represent hydrogen, a C1-C6 alkyl group which may have a substituent, or a C1-C6alkoxy group which may have a substituent.

7. The electrophotographic photoconductor according to claim 6, wherein the charge transporting material represented by the General Formula (2) is a charge transporting material expressed by the following Formula (2-1):

(2-1)

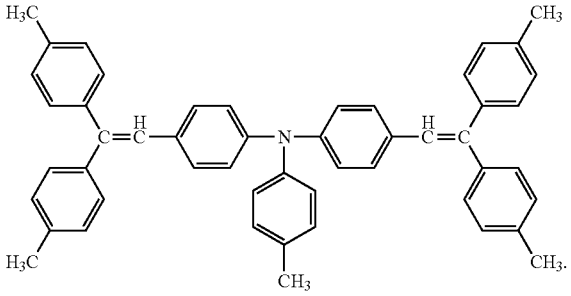

8. An electrophotographic apparatus comprising:

an electrophotographic photoconductor;

a charging unit;

an exposing unit;
a developing unit;
a cleaning unit; and
a transfer unit,
wherein the electrophotographic photoconductor is an electrophotographic photoconductor comprising:
an electroconductive substrate;
an intermediate layer; and
a photoconductive layer,
the intermediate layer and the photoconductive layer being on the electroconductive substrate,
wherein the intermediate layer comprises an inorganic pigment and a binder resin,
wherein a volume ratio of the inorganic pigment in the intermediate layer is 30% by volume to 50% by volume,
wherein the inorganic pigment comprises titanium oxide and a content of the titanium oxide in the inorganic pigment is 70% by mass to 90% by mass,
wherein the inorganic pigment has a specific surface area of 70 $m^2/g$ to 140 $m^2/g$, and
wherein the intermediate layer has a volume resistivity at an electrical field intensity of $2.5\times10^5$ V/cm of $5\times10^{11}$ Ω·cm to $1\times10^{13}$ Ω·cm.

9. The electrophotographic apparatus according to claim 8,
wherein the exposing unit is a LED light source, and
wherein the developing unit is a developing unit configured to perform development with a one-component developer.

10. A process cartridge comprising:
an electrophotographic photoconductor; and
a charging unit, an exposing unit, a developing unit, a cleaning unit or a transfer unit, or any combination thereof,
wherein the electrophotographic photoconductor is an electrophotographic photoconductor comprising:
an electroconductive substrate;
an intermediate layer; and
a photoconductive layer, the intermediate layer and the photoconductive layer being on the electroconductive substrate,
wherein the intermediate layer comprises an inorganic pigment and a binder resin,
wherein a volume ratio of the inorganic pigment in the intermediate layer is 30% by volume to 50% by volume,
wherein the inorganic pigment comprises titanium oxide and a content of the titanium oxide in the inorganic pigment is 70% by mass to 90% by mass,
wherein the inorganic pigment has a specific surface area of 70 $m^2/g$ to 140 $m^2/g$, and
wherein the intermediate layer has a volume resistivity at an electrical field intensity of $2.5\times10^5$ V/cm of $5\times10^{11}$Ω·cm to $1\times10^{13}$ Ω·cm.

* * * * *